US009863658B2

(12) United States Patent
Cho

(10) Patent No.: US 9,863,658 B2
(45) Date of Patent: Jan. 9, 2018

(54) ROOM MANAGEMENT APPARATUS AND METHOD FOR ASSIGNING ROOMS BASED ON AIR CONDITIONER STATE AND ROOM TEMPERATURE

(71) Applicant: LG ELECTRONICS INC., Seoul (KR)

(72) Inventor: Junghyun Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 556 days.

(21) Appl. No.: 14/341,560

(22) Filed: Jul. 25, 2014

(65) Prior Publication Data

US 2015/0057813 A1 Feb. 26, 2015

(30) Foreign Application Priority Data

Aug. 26, 2013 (KR) ..... 10-2013-0101043

(51) Int. Cl.
*F24F 11/00* (2006.01)

(52) U.S. Cl.
CPC ..... *F24F 11/0034* (2013.01); *F24F 11/006* (2013.01); *F24F 11/0086* (2013.01); *F24F 2011/0063* (2013.01); *F24F 2011/0067* (2013.01); *F24F 2011/0091* (2013.01)

(58) Field of Classification Search
None
See application file for complete search history.

(56) References Cited

U.S. PATENT DOCUMENTS 5,305,825 A * 4/1994 Roehrich ..... F25D 29/001 165/61
5,682,949 A 11/1997 Ratcliffe et al.
2003/0140637 A1* 7/2003 Masui ..... F24F 11/006 62/127
2003/0149576 A1* 8/2003 Sunyich ..... G06Q 30/02 705/5
2003/0163222 A1 8/2003 Choi
2006/0190306 A1* 8/2006 Ishibashi ..... G06Q 10/02 705/5
2008/0178615 A1* 7/2008 Yoon ..... F24F 3/06 62/79
2010/0070087 A1* 3/2010 Shima ..... F24F 11/0086 700/277
2014/0257879 A1* 9/2014 Sink ..... G06Q 10/02 705/5

FOREIGN PATENT DOCUMENTS

GB 2 258 743 A 2/1993
KR 10-2013-0042849 A 4/2013

OTHER PUBLICATIONS

European Search Report dated Jan. 30, 2015 issued in Application No. 14173460.8.

* cited by examiner

*Primary Examiner* — Mohammad Ali
*Assistant Examiner* — Bernard G Lindsay
(74) *Attorney, Agent, or Firm* — Ked & Associates, LLP

(57) ABSTRACT

A room management apparatus is provided. The room management apparatus includes a central controller that recognizes an operation state of an air conditioner, and determines that one or more rooms are assignable on the basis of the operation state of the air conditioner.

14 Claims, 6 Drawing Sheets

ROOM MANAGEMENT APPARATUS AND METHOD FOR ASSIGNING ROOMS BASED ON AIR CONDITIONER STATE AND ROOM TEMPERATURE

CROSS-REFERENCE TO RELATED APPLICATIONS

The present application claims priority under 35 U.S.C. 119 and 35 U.S.C. 365 to Korean Patent Application No. 10-2013-0101043 (filed on Aug. 26, 2013), which is hereby incorporated by reference in its entirety.

BACKGROUND

The present disclosure relates to a room management apparatus and method.

As a prior art, Korean patent application publication No. 2013-0042849 discloses a hotel room management and control apparatus.

The above-described patent document discloses a temperature controller for independently controlling temperature of a hotel room. In addition, the patent document also discloses a technology that a guest may perform various requests by using a touch pad in a room.

However, although disclosing various technologies for convenience of the guest, the patent document does not provide a technology for reducing energy in room assignment.

SUMMARY

Embodiments provide room management apparatuses and methods for recognizing a state of an air conditioner and efficiently assigning rooms.

In one embodiment, a room management apparatus includes: a central controller that recognizes an operation state of an air conditioner, and determines that one or more rooms are assignable on the basis of the operation state of the air conditioner.

The air conditioner may include a plurality of outdoor units, and the central controller recognizes indoor units corresponding to one or more outdoor units in operation or to be operated from among the plurality of outdoor units, and determines rooms corresponding to the recognized indoor units as one or more assignable rooms.

The central controller may comprise a first controller to control the air conditioner; a first memory to store operation state information on the air conditioner; a second controller to determine the one or more assignable rooms on the basis of the operation state information on the air conditioner; and a second memory to store room information.

The central controller may comprise a display unit to display information on the one or more assignable rooms.

The apparatus may further comprises a terminal for a manager communicating with the central controller and comprising a display unit to display information on the one or more assignable rooms.

The display may display information on the one or more assignable rooms for each floor.

The display unit may further display information on rooms that assignments are completed and information on rooms that assignments are not recommended.

The display unit may display information on the one or more assignable rooms on a first region, and information for selecting a floor on a second region.

The display unit may display information on all the assignable rooms.

Some of all the assignable rooms may be determined according to a priority among all the assignable rooms, and the display unit distinguishably displays information on the rooms determined according to the priority and information on rooms not determined according to the priority.

Some of all the assignable rooms may be determined according to a priority among all the assignable rooms, and the display unit displays information on the some of all the assignable rooms determined according to the priority among all the assignable rooms.

The priority may be determined on the basis of each temperature of all the assignable rooms.

In another embodiment, a room managing method includes: collecting, by a central controller, room assignment conditions; recognizing, by the central controller, an operation state of an air conditioner and recognizing current states of the rooms; selecting one or more assignable rooms on the basis of the operation state of the air conditioner and the current states of the rooms; and displaying the one or more assignable rooms on a display unit of the central controller.

The air conditioner comprises a plurality of outdoor units, and in the selecting of the assignable rooms, the indoor units corresponding to one or more outdoor units in operation or to be operated are recognized and rooms corresponding to recognized indoor units are determined as the one or more assignable rooms.

The method may further comprise transmitting, by the central controller, information on the one or more assignable rooms to a terminal for a manager.

In further another embodiment, a room management apparatus collecting room assignment conditions and assigning rooms, includes a central controller checking an operation state of an air conditioner through communication with the air conditioner and recognizing one or more assignable rooms on the basis of the operation state of the air conditioner, the collected room assignment conditions, and current room states.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the disclosure may be practiced. These embodiments are described in sufficient detail to enable those skilled in the art to practice the disclosure, and it is understood that other embodiments may be utilized and that logical structural, mechanical, electrical, and chemical changes may be made without departing from the scope of the disclosure. To avoid detail not necessary to enable those skilled in the art to practice the disclosure, the description may omit certain information known to those skilled in the art. The following detailed description is, therefore, not to be taken in a limiting sense.

Hereinafter, the embodiments of the present disclosure will now be described in detail with reference to the accompanying drawings.

Figure 1:
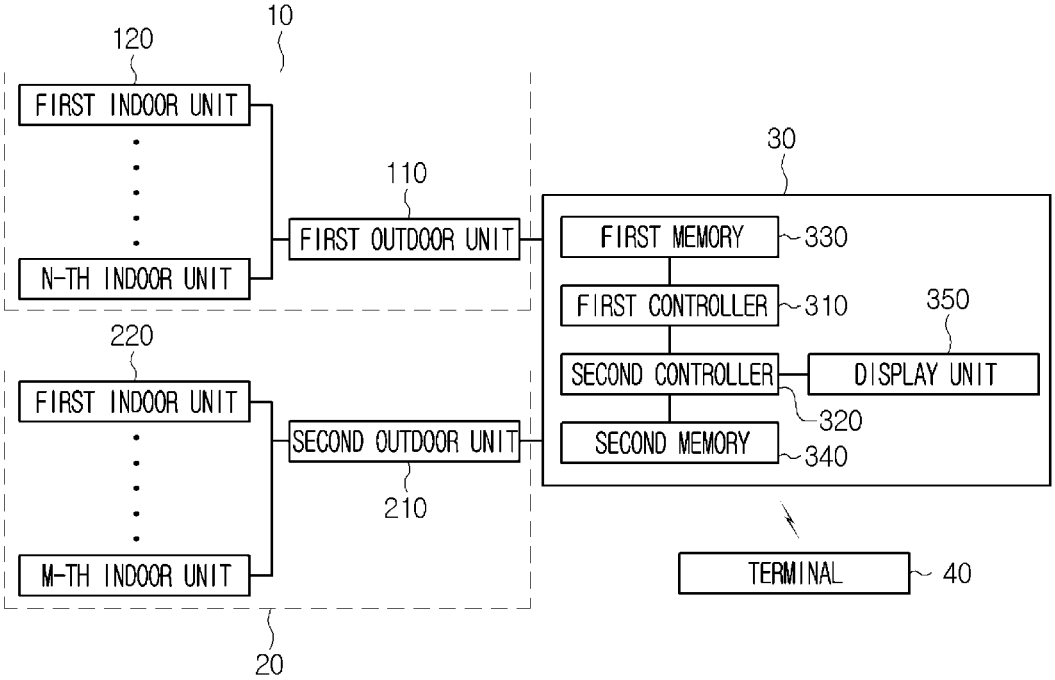
FIG. 1 is a block diagram illustrating a room management apparatus according to an embodiment.

FIG. 1 is a block diagram illustrating a room management apparatus according to an embodiment.

Referring to FIG. 1, the room management apparatus according to an embodiment may manage rooms in a building, such as a hotel or resort.

The room management apparatus may include air conditioners 10 and 20, and a central controller 30 that assigns rooms on the basis of operation information on the air conditioners 10 and 20.

The air conditioners 10 and 20 may include one or more outdoor units 110 and 210, a plurality of indoor units 120 and 220 connected to the outdoor units 110 and 210. FIG. 1 exemplarily shows that the plurality of indoor units 120 and 220 are connected to each of the two outdoor units 110 and 210.

In a building, such as a hotel or resort, for staying, each of the indoor units 120 and 220 may be assigned to each room, and each room and each of the indoor units 120 and 220 may be matched.

For example, room 101 may match a first indoor unit, room 102 may match a second indoor unit, and room 103 may match a third indoor unit.

In the present embodiment, a plurality of indoor units connected to one outdoor unit may be called as an indoor unit group.

The central controller 30 may perform wired or wireless communication with the air conditioners 10 and 20. For example, the central controller 30 may perform wired or wireless communication with the outdoor units 110 and 210.

The central controller 30 may include a first controller 310 capable of controlling operations of the air conditioners 10 and 20 and recognizing operation states thereof, and a second controller 320 for room management. The two controllers 310 and 320 may perform individual controls or perform functions that one controller is functionally divided.

Alternatively, it is also possible that one controller controls the air conditioners 10 and 20 while performing room management at the same time. The second controller 320 may recognize assignable rooms on the basis of operation state information on the air conditioners 10 and 20.

The central controller 30 may further include a first memory 330 storing information on operations of the air conditioners 10 and 20 and matching information on an indoor unit for each room.

In addition, the central controller 30 may further include a second memory storing information related to room management. The information related to room management may include room reservation information, room assignment information, or information on a guest of a guest-assigned room.

The central controller 30 may include a display unit 350 displaying various pieces of information for room management and various pieces of information for operation controls of the air conditioners 10 and 20.

Although not shown in the drawing, the central controller 30 may include an input unit for inputting various commands for room assignment and operation commands for the air conditioners 10 and 20.

On the other hand, the room management apparatus may further include a terminal for a manager 40 (hereinafter "terminal") capable of communicating with the central controller 30.

The terminal 40 is a terminal that is carriable by a manager and may include a display unit displaying information displayed on the display unit 350 of the central controller 30.

Figure 2:
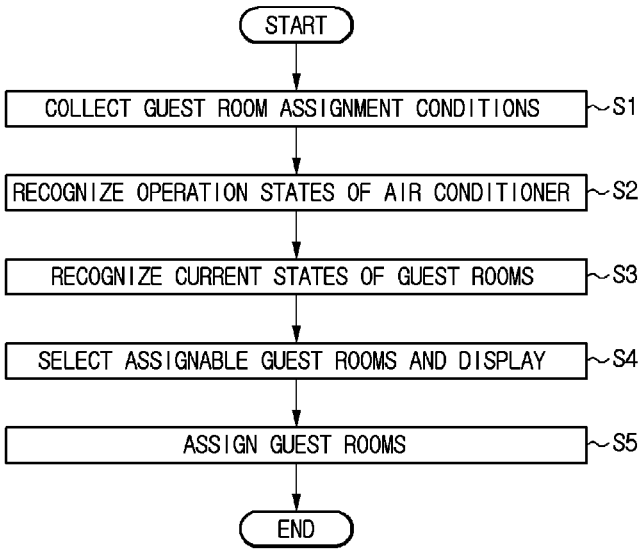
FIG. 2 is a flowchart illustrating a room management method according to an embodiment.
Figure 3:
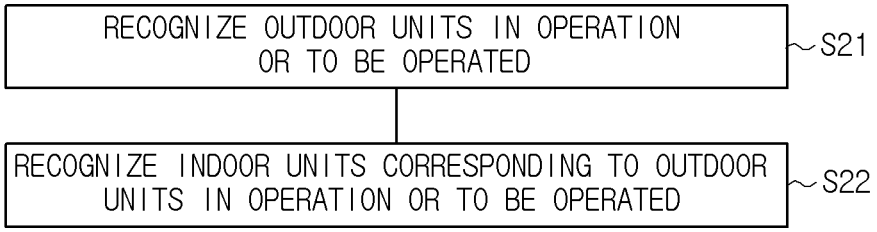
FIG. 3 is a flowchart illustrating a process of recognizing a state of an air conditioner.

FIG. 2 is a flowchart illustrating a room management method according to an embodiment, and FIG. 3 is a flowchart illustrating a process of recognizing a state of the air conditioner.

Referring to FIGS. 2 and 3, in order to assign rooms, room assignment conditions are collected (operation S1). The room assignment condition may be collected in real time through the input unit of the central controller 30, collected through the terminal 40, or collected by a user who accesses a web server and collects pre-reserved information. At this point, the central controller 30 may communicate with the web server and information input by the user through the web server is stored in the second memory 340 of the central controller 30.

Information collected in real time through the input unit of the central controller 30 or information input through the terminal 40 may also be stored in the second memory 340.

The room assignment condition may include check-in date, period of stay, grade of a room to stay, or whether to be able to smoke.

Then, the central controller 30 may recognize operation states of the air conditioners 10 and 20 (operation S2). In detail, the first controller 310 may recognize the outdoor units in operation or to be operated (operation 21).

Then, the first controller 310 may recognize the indoor units corresponding to the outdoor units recognized as in operation or to be operated (operation S22).

For example, when the first outdoor unit 110 is in operation and the second outdoor unit 210 is in a stop state, information on the indoor unit 120 connected to the first outdoor unit 110 is extracted. At this point, the extracted information on the indoor unit 120 may include information on an indoor unit in non-operation as well as information on an indoor unit in operation.

Since the operation information on the air conditioners 10 and 20 is stored in the first memory 330, the first controller 310 may perform operations S21 and S22 on the basis of information stored in the first memory 330. For another example, the first controller 310 may request state information from each of the outdoor units 110 and 210 of the air conditioners 10 and 20, receive operation information for the outdoor units 110 and 210, and perform operations S21 and S22. At this point, the information (information on the indoor units corresponding to the outdoor units in operation or to be operated) recognized by the first controller 110 may be stored in the first memory 330.

Since the room is matched to each indoor unit, in operation S2, recognizing of the operation states of the air conditioners may be understood as recognizing rooms having indoor units therein, which correspond to outdoor units in operation or to be operated.

The central controller 30 may recognize current states of rooms on the basis of information stored in the second memory 340. In detail, the second controller 320 may recognize rooms that are vacant on the basis of information stored in the second memory 340. For example, the second controller 320 may recognize vacant rooms that satisfy reservation information on a user.

In addition, the central controller 30 may select assignable rooms on the basis of collected room assignment conditions, operation states of the air conditioners, and current states of the rooms, and display information on the selected assignable rooms on the display unit 350 (operation S4). In detail, the second controller 320 may select assignable rooms on the basis of information recognized in operation S2 and information recognized in operation S3.

Although operations S2, S3, and S4 are described as individual operations for convenience of explanation, operation S2 to S4 may be one operation or individual operations. Alternatively, operations S2 and S3 may be one operation or operations S3 and S4 may be one operation.

Furthermore, when rooms are selected on the basis of room information displayed on the display unit 350, room assignment is completed (operation S5).

In an embodiment, indoor units corresponding to the selected rooms may be in operation or stopped.

In an embodiment, although an indoor unit connected to an outdoor unit in operation corresponds to a vacant room, the central controller 30 may operate the indoor unit in order to maintain a certain temperature for comfort of the room.

Accordingly, when a room connected to the indoor unit in operation is vacant, the room may be classified as an assignable room.

Figure 4:
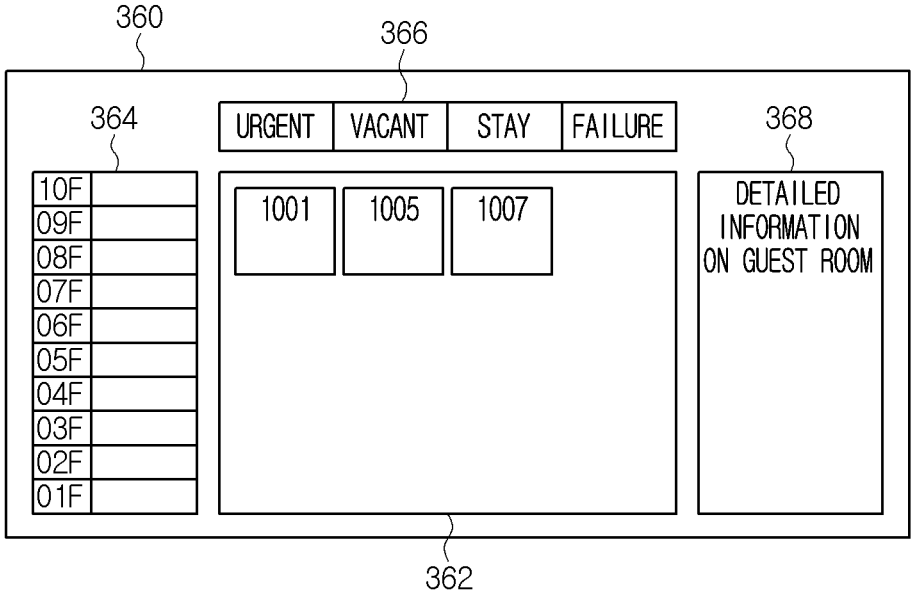
FIG. 4 is a view showing a management screen displayed on a display unit according to an embodiment.
Figure 5:
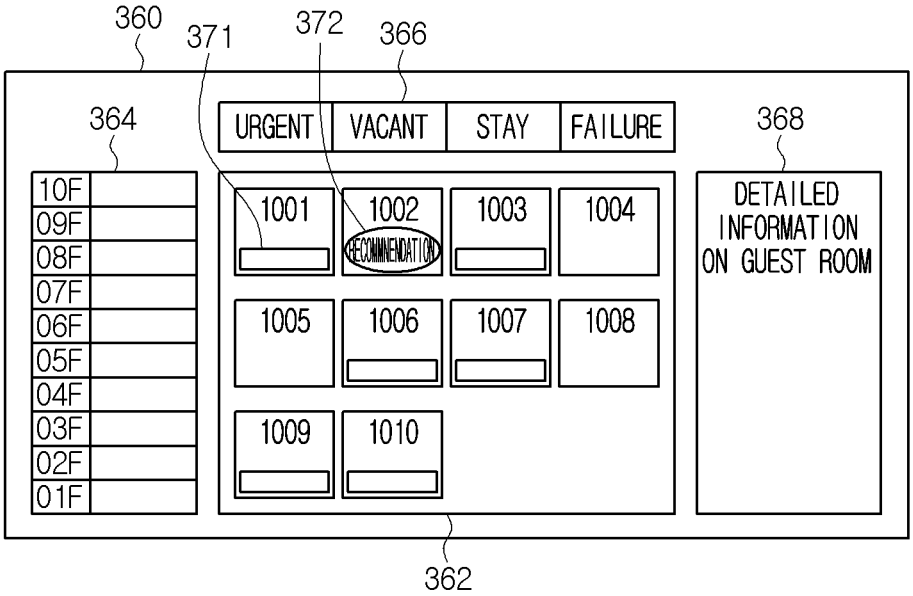
FIG. 5 is a view showing a management screen displayed on a display unit according to another embodiment.
Figure 6:
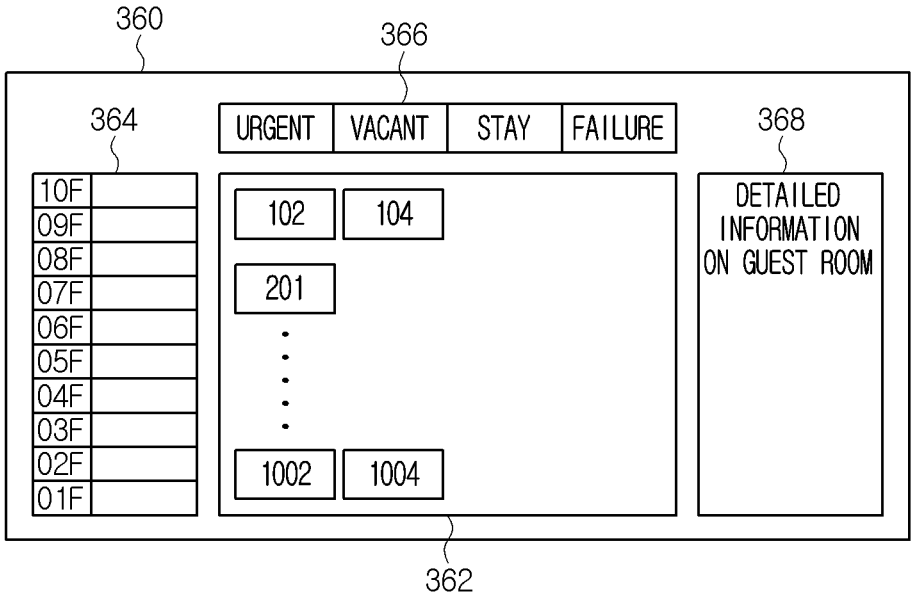
FIG. 6 is a view showing a management screen displayed on a display unit according to another embodiment.

FIG. 4 is a view showing a management screen displayed on the display unit according to an embodiment, FIG. 5 is a view showing a management screen displayed on the display unit according to another embodiment, and FIG. 6 is a view showing a management screen displayed on the display unit according to another embodiment.

Firstly, referring to FIG. 4, a management screen 360 for room management may be displayed on the display unit 350.

The management screen 360 may include at least one selected from a first region 362 on which room information may be displayed, a second region 364 distinguishably showing room information for each floor, a third region 366 displaying a menu for showing rooms for each category, and a fourth region 368 displaying detailed information on a corresponding room, when any one room is selected from among rooms displayed on the first region 362.

In the management screen 360, the plurality of regions 362 to 368 may be simultaneously displayed. In addition, in the management screen 360, only some of the plurality of regions 362 to 368 may be displayed. For example, on the management screen 360, at least one of the second to fourth regions 364 to 368 may be displayed with the first region 362.

In the embodiment, in operation S4 in FIG. 2, the display unit 350 may allow at least the first region 362 to be displayed on the management screen 360.

In the first region 362, only information on at least one room that is assignable on a specific floor may be displayed. At this point, information displayed on the first region 362 may be distinguished for each room.

As described above, an assignable room is matched to an indoor unit corresponding to an outdoor unit in operation or to be operated. When there is an assignable room on another floor, the second region 364 on which a floor is selectable may be further displayed on the management screen 360. In this case, the manager may select the floor and check information on an assignable room for each floor.

For another example, referring to FIG. 5, in the first region 362, information on all the rooms on the specific floor is displayed. In addition, information on assignable rooms, information on rooms that assignments are completed, and information on rooms that assignments are not recommended may be additionally displayed.

In FIG. 5, for example, the assignable room is 1002, the rooms that the assignments are completed are 1001, 1003, 1006, 1007, 1009, and 1010, and the rooms that assignments are not recommended are 1004, 1005, and 1008.

The rooms that assignments are not recommended in the embodiment may represent rooms that are vacant but are not determined as assignable. That is, outdoor units to which indoor units corresponding to the rooms that assignments are not recommended are connected do not operate. However, the rooms that assignments are not recommended in the embodiment are not assignable by the manager or may be assigned by the manager.

The information on the rooms that the assignments are completed may include information 371 (e.g., check-in date or period of stay) related to staying in rooms. The information on the assignable rooms may include information 372 for notifying that they are assignable.

For another example, referring to FIG. 6, information on assignable rooms on all the floors may be displayed on the first region 362. That is, information on all the assignable rooms may be displayed on the first region 362.

When the information on assignable rooms is not simultaneously displayable on the first region 362, a scroll or an arrow for page redirection may be displayed on the first region 362.

On the other hand, a menu displayed on the third region 366 may include at least one of "urgent", "vacant", "staying", and "failure". An urgent button is for confirming information on a room from which an urgent request is received. When the urgent button is selected, the information on the room from which a request for urgent treatment is received may be displayed on the first region 362.

The vacant button is for confirming information on an assignable room. When the vacant button is selected, the information on an assignable room may be displayed on the first region 362 as shown in FIG. 4 or 5.

The staying button is for confirming information on a room that the assignment is completed, and the failure button is for confirming information on a room that is not assignable due to failure, etc.

The menu displayed on the third region 366 may include "all". In this case, information on all the rooms may be displayed as shown in FIG. 6.

Additional embodiments are proposed.

In the above embodiment, it is described that even when an indoor unit corresponding to a vacant room is in operation, the room corresponding to the indoor unit is assignable. However, when the room is vacant and the indoor unit is controlled so as not to be operated, only indoor units in non-operation are recognized in operation S2.

For another example, when a room determined as assignable is in plurality, information on one room determined as having the highest priority or some rooms determined according to the priority among the plurality of assignable rooms may be displayed on the first region 362.

In other words, only some rooms preferentially selected from among the plurality of assignable rooms may be displayed on the first region 362. Alternatively, information on all assignable rooms on a specific floor may be displayed on the first region 362 as in FIG. 4, or information on all the assignable rooms on all the floors may be displayed on the first region 362 as in FIG. 6, but some rooms determined according to the priority from among all assignable rooms may be distinguishably displayed from the rest of the assignable rooms, which is not determined according to the priority. For example, the information on the rooms determined according to the priority may additionally include text information such as "recommendation" or information such as a symbol, or the information on the rooms determined according to the priority may be differently displayed from the information on the assignable rooms not determined according to priority in terms of a size, shape, or color of the information.

In the above-described examples, the priority may be determined with state information on the rooms. For example, the priority may be determined according to current temperatures of the rooms. For example, in summer, temperatures of three vacant rooms are compared with each other and a room having the lowest temperature may be determined as having the highest priority. It should be noted that the method of determining the priority is not limited.

According to the proposed embodiment, since the assignable rooms are recognized on the basis of an operation state of an air conditioner, an energy saving effect can be achieved.

For example, when a room in which an indoor unit corresponding to an outdoor unit in operation is installed is assigned, even when the installed indoor unit (assumed to be in stop state) is turned on, since the outdoor unit is already turn on, unnecessary energy consumption does not occur.

On the contrary, when a room in which an indoor unit corresponding to an outdoor unit in non-operation is installed is assigned and the installed indoor unit (assumed to be in stop state) is turned on, since the outdoor unit in non-operation is required to be turned on, unnecessary energy consumption occurs.

Accordingly, in the embodiment, since assignable rooms are recognized on the basis of an operation state of an air conditioner, unnecessary energy consumption is reduced and an energy saving effect can be achieved.

What is claimed is:

1. A room management apparatus comprising:

a central controller to receive information relating to an operation state of an air conditioner, and to determine that one or more rooms are assignable to a user based on the operation state of the air conditioner, wherein the central controller includes:

a first controller to control the air conditioner;

a first memory to store operation state information of the air conditioner;

a second controller to determine one or more assignable rooms based on the operation state information of the air conditioner; and a second memory to store room information, wherein the air conditioner includes a plurality of outdoor units, each of the plurality of outdoor units is connected to two or more indoor units, and the central controller is configured to determine one or more indoor units corresponding to one or more outdoor units in operation or to be operated from among the plurality of outdoor units, and the central controller to determine, as the assignable rooms, one or more rooms corresponding to the determined indoor units corresponding to one or more outdoor units in operation or to be operated, wherein the central computer to receive temperature information from each of a plurality of vacant rooms, and the central computer to determine that a room having a lowest temperature, from among the plurality of vacant rooms, has a highest priority from among the assignable rooms.

2. The apparatus according to claim 1, wherein the central controller includes a display unit to display information on the determined one or more assignable rooms.

3. The apparatus according to claim 2, wherein the display unit displays information on the one or more assignable rooms for each floor.

4. The apparatus according to claim 3, wherein the display unit displays information on rooms that assignments are completed and information on rooms that assignments are not recommended.

5. The apparatus according to claim 3, wherein the display unit displays, on a first region, information on the one or more assignable rooms, and the display unit displays, on a second region, information for selecting a floor.

6. The apparatus according to claim 2, wherein the display unit displays information on all assignable rooms.

7. The apparatus according to claim 6, wherein some of all the assignable rooms are determined according to a priority among all the assignable rooms, and the display unit distinguishably displays information on rooms determined according to the priority and information on rooms not determined according to the priority.

8. The apparatus according to claim 2, wherein some of all the assignable rooms are determined according to a priority among the all of the assignable rooms, and the display unit displays information on the some of all the assignable rooms, which are determined according to the priority among all the assignable rooms.

9. The apparatus according to claim 2, further comprising a terminal for a manager that communicates with the central controller and the terminal includes a display unit to display information on the one or more assignable rooms.

10. A room managing method comprising:

collecting, by a central controller, room assignment conditions, wherein the central controller includes a first controller a first memory, a second controller and a second memory, the first controller to control an air conditioner, the first memory to store operation state information of the air conditioner, the second controller to determine one or more assignable rooms based on the operation state information of the air conditioner, and the second memory to store room information;

determining, by the central controller, an operation state of the air conditioner and determining current states of the rooms;

selecting one or more assignable rooms based on the operation state of the air conditioner and the current states of the rooms; and displaying the selected assignable rooms on a display unit of the central controller, wherein the air conditioner includes a plurality of outdoor units, each of the plurality of outdoor units is connected to two or more indoor units, and in the selecting of the one or more assignable rooms, the indoor units corresponding to one or more outdoor units in operation or to be operated are determined and rooms corresponding to the determined indoor units are determined as the one or more assignable rooms, wherein the central computer to receive temperature information from each of a plurality of vacant rooms, and the central computer to determine that a room having a lowest temperature, from among the plurality of vacant rooms, has a highest priority from among the assignable rooms.

11. The method according to claim 10, further comprising:

transmitting, by the central controller, information on the selected one or more assignable rooms to a terminal for a manager; and displaying, on a display unit of the terminal, the information of the one or more assignable rooms.

12. A room management apparatus to collect room assignment conditions and to assign one or more rooms, comprising:

a central controller to receive information relating to an operation state of an air conditioner through communication with the air conditioner and to determine one or more assignable rooms based on the operation state of the air conditioner, the collected room assignment conditions, and current room states, wherein the central controller includes:

a first controller to control the air conditioner;

a first memory to store operation state information of the air conditioner;

a second controller to determine one or more assignable rooms based on the operation state information of the air conditioner; and a second memory to store room information, wherein the air conditioner includes a plurality of outdoor units, each of the plurality of outdoor units is connected to two or more indoor units, and the central controller determines the indoor units corresponding to one or more outdoor units in operation or to be operated, and the central controller determines rooms corresponding to the determined indoor units as the one or more assignable rooms, wherein the central computer to receive temperature information from each of a plurality of vacant rooms, and the central computer to determine that a room having a lowest temperature, from among the plurality of vacant rooms, has a highest priority from among the assignable rooms.

13. The apparatus according to claim 12, wherein the central controller includes a display unit to display information on the determined one or more assignable rooms.

14. The apparatus according to claim 13, wherein the display unit displays information on the one or more assignable rooms for each floor, displays information on all the assignable rooms, or displays some of the assignable rooms determined according to a priority among all the assignable rooms.

* * * * *